US008777717B2

(12) United States Patent
Shaw

(10) Patent No.: US 8,777,717 B2
(45) Date of Patent: Jul. 15, 2014

(54) NUMBER-BASED GAME SYSTEM AND METHOD WHEREIN PLAYERS VOTE TO DETERMINE THE SELECTION OF GAME NUMBERS FROM A PLURALITY OF RANDOMLY SELECTED GAME NUMBERS AND/OR SYMBOLS

(75) Inventor: Edwin W. Shaw, Surrey (CA)

(73) Assignee: Kodiak Entertainment, Burnaby (CA)

( * ) Notice: Subject to any disclaimer, the term of this patent is extended or adjusted under 35 U.S.C. 154(b) by 672 days.

(21) Appl. No.: 13/021,224

(22) Filed: Feb. 4, 2011

(65) Prior Publication Data

US 2011/0195771 A1 Aug. 11, 2011

Related U.S. Application Data

(60) Provisional application No. 61/301,774, filed on Feb. 5, 2010.

(51) Int. Cl.
*G06F 17/00* (2006.01)

(52) U.S. Cl.
USPC ..... 463/19

(58) Field of Classification Search
USPC ..... 463/16–25; 273/269, 274; 705/1
See application file for complete search history.

(56) References Cited

U.S. PATENT DOCUMENTS

| | | | | |
|---|---|---|---|---|
| 6,186,892 | B1 * | 2/2001 | Frank et al. | 463/19 |
| 6,398,645 | B1 * | 6/2002 | Yoseloff | 463/19 |
| 6,755,738 | B2 * | 6/2004 | Glasson et al. | 463/19 |
| 6,810,528 | B1 | 10/2004 | Chatani | |
| 7,485,043 | B2 | 2/2009 | Beaulieu et al. | |
| 7,717,785 | B2 * | 5/2010 | Odom | 463/19 |
| 7,997,581 | B2 * | 8/2011 | Brennan | 273/269 |
| 2003/0125107 | A1 | 7/2003 | Cannon | |
| 2007/0043584 | A1 * | 2/2007 | Waters | 705/1 |
| 2009/0029759 | A1 * | 1/2009 | Brandt | 463/19 |
| 2009/0075714 | A1 * | 3/2009 | Meyer et al. | 463/19 |
| 2009/0191956 | A1 * | 7/2009 | Lyons et al. | 463/26 |

FOREIGN PATENT DOCUMENTS

CA 2446037 A1 11/2002

* cited by examiner

*Primary Examiner* — Ronald Laneau
(74) *Attorney, Agent, or Firm* — Rob L. Phillips; Greenberg Traurig, LLP

(57) ABSTRACT

A system and method of use wherein players are allowed to vote on a game number from multiple game numbers wherein the game number receiving the most votes is selected as a next game number. Games involving multiple player, including bingo and lottery-style games, may benefit from the disclosed system and method. Given a large set of players and over the course of the game, the voting scheme does not impact the random nature of the game outcome. Advantageously, and despite the continued randomness of game outcomes, players tend to believe that the voting scheme impacts the game outcome by skewing the game outcome in the player's favor. Accordingly, the interactive nature of the game is attractive to players especially new and young players having grown up with interactive video games and also provides more experienced players with a new spin on old games.

15 Claims, 7 Drawing Sheets

NUMBER-BASED GAME SYSTEM AND METHOD WHEREIN PLAYERS VOTE TO DETERMINE THE SELECTION OF GAME NUMBERS FROM A PLURALITY OF RANDOMLY SELECTED GAME NUMBERS AND/OR SYMBOLS

CROSS REFERENCE

This application claims the benefit of U.S. Provisional Patent Application No. 61/301,774 filed Feb. 5, 2010.

FIELD OF THE INVENTION

The embodiments of the present invention relate to number games during which players vote for game numbers from two or more randomly selected game numbers.

BACKGROUND

Number games, such as bingo, keno and lotteries, are based on the random selection of game numbers which determine the winner or winners of the games. However, such games lack player interaction beyond the player selecting the bingo card or player keno and lottery numbers which are compared to the randomly selected numbers to determine a game winner. Today's game players have been raised on interactive games (e.g., video games) such that they may not be interested in numbers games which offer little interaction.

Accordingly, it would be advantageous to add interaction to numbers games such as bingo, keno, lotteries and the like. The interaction allows game players to vote on game numbers from multiple randomly selected game numbers.

SUMMARY

Accordingly, one embodiment of the present invention is a method of playing a number game comprising: (a) randomly selecting two or more game numbers from a pool of game numbers; (b) presenting the randomly selected two or more game numbers to the players; (c) accepting player votes via said interface on the two or more randomly selected game numbers; (d) tallying votes on each of said two or more randomly selected game numbers to determine a game number receiving the most votes; and (e) selecting as a next game number the game number receiving the most votes.

One system according to the embodiments of the present invention comprises: multiple electronic gaming machines each including at least a display and an interface capable of accepting instructions from a player wherein said multiple electronic gaming machines are in communication with a random number generator and a processor for controlling a bingo game wherein said processor is configured to: provide players with bingo cards from a pool of bingo cards and accept payment for one or more of said bingo cards; and one or more times during the bingo game: (a) randomly select two or more bingo numbers from a pool of bingo numbers; (b) present the randomly selected two or more bingo numbers to the players; (c) accept player votes via said interface on the two or more randomly selected bingo numbers; (d) tally votes on each of said two or more randomly selected bingo numbers to determine a bingo number receiving the most votes; and (e) select as a next bingo number the bingo number receiving the most votes.

The system and method may be used with bingo, keno and lottery-style games wherein player numbers are compared to randomly-selected game numbers to determine game outcomes. In any such game, multiple players may be permitted to vote on multiple game numbers such that the next selected game number is deemed the game number receiving the most votes. In the event of a tie, whereby two or more bingo numbers, for example, receive the most votes, a random selection process causes one of the bingo numbers to be selected as the next bingo number in the bingo game. Given a large set of players and over the course of the game, the voting scheme does not impact the random nature of the game outcome (or if it does, it is a very small fluctuation). Advantageously, and despite the continued randomness of game outcomes, players tend to believe that the voting scheme impacts the game outcome by skewing the game outcome in the player's favor. Accordingly, the interactive nature of the game is attractive to players especially new and young players raised on interactive video games.

Other variations, embodiments and features of the present invention will become evident from the following detailed description, drawings and claims.

DETAILED DESCRIPTION

It will be appreciated by those of ordinary skill in the art that the invention can be embodied in other specific forms without departing from the spirit or essential character thereof. The presently disclosed embodiments are therefore considered in all respects to be illustrative and not restrictive As set forth above, the embodiments of the present invention may be used with bingo, keno and lottery-style games wherein player numbers are compared to randomly-selected game numbers to determine game outcomes. Nonetheless, for the sake of brevity, the detailed description below focuses on a bingo game. In addition, the games are played on gaming devices using conventional technology such as processors and/or controllers, servers, memory, random generation means, game stations and terminals, including monitors and player interfaces comprising game buttons and touch screens. The games may be played on networked terminals, standalone gaming devices, hand-held devices and the like. Those skilled in the art understand the art of electronic gaming machines and thus the minute details are not set forth herein.

In one embodiment, a bingo game is facilitated by a series of electronic gaming machines or terminals each having at least a display and user interface linked to a central server having a processor and random number generator. A controller or similar device may act as an interface between the server and electronic gaming machines. Players use the electronic gaming machines or terminals to purchase bingo cards after which the server handles randomly drawing bingo balls which are presented to all players via the displays of the electronic gaming machines or terminals. Players may then electronically daub their bingo cards based on the drawn bingo numbers. The system may also daub bingo cards automatically. Once a bingo game winner is identified the game ends. As described herein, the electronic gaming machines may be locally arranged (e.g. bingo hall) or remotely located (e.g., online virtual bingo hall) relative to the server.

Figure 1:
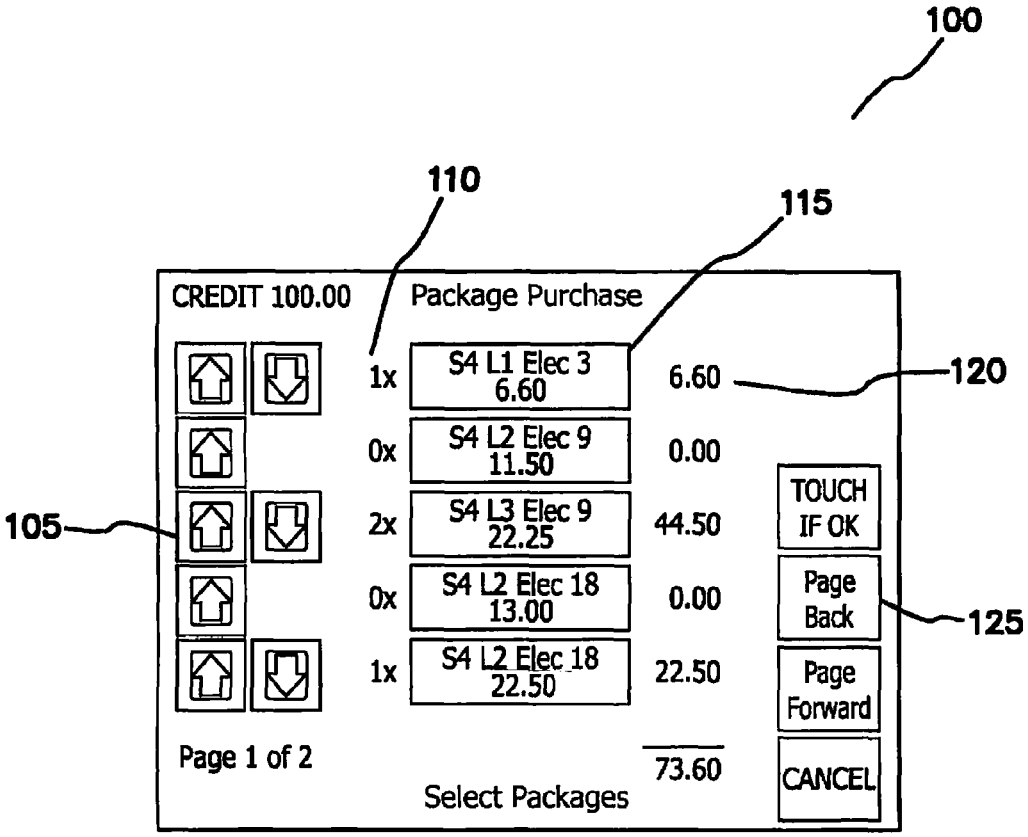
FIG. 1 illustrates a bingo card purchase screen shot of a conventional type.
Figure 2A:
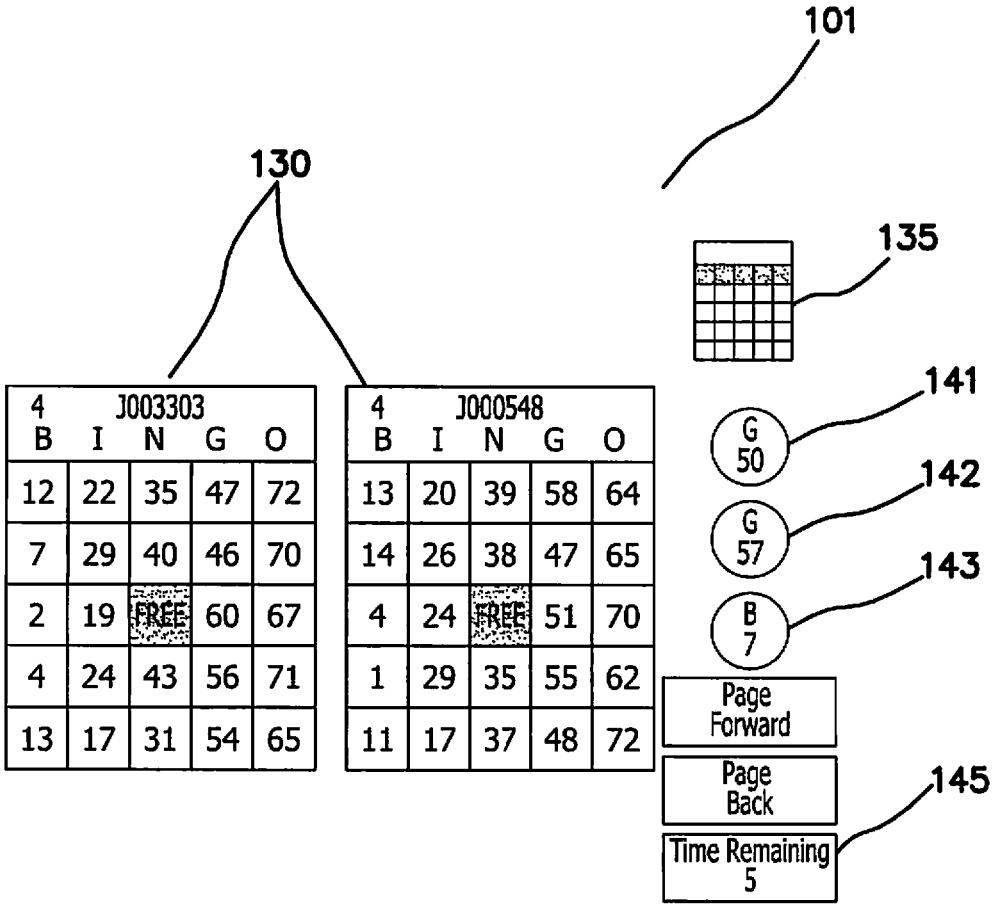
FIGS. 2*a*-2*d* illustrate various screen shots according to the embodiments of the present invention.
Figure 2B:
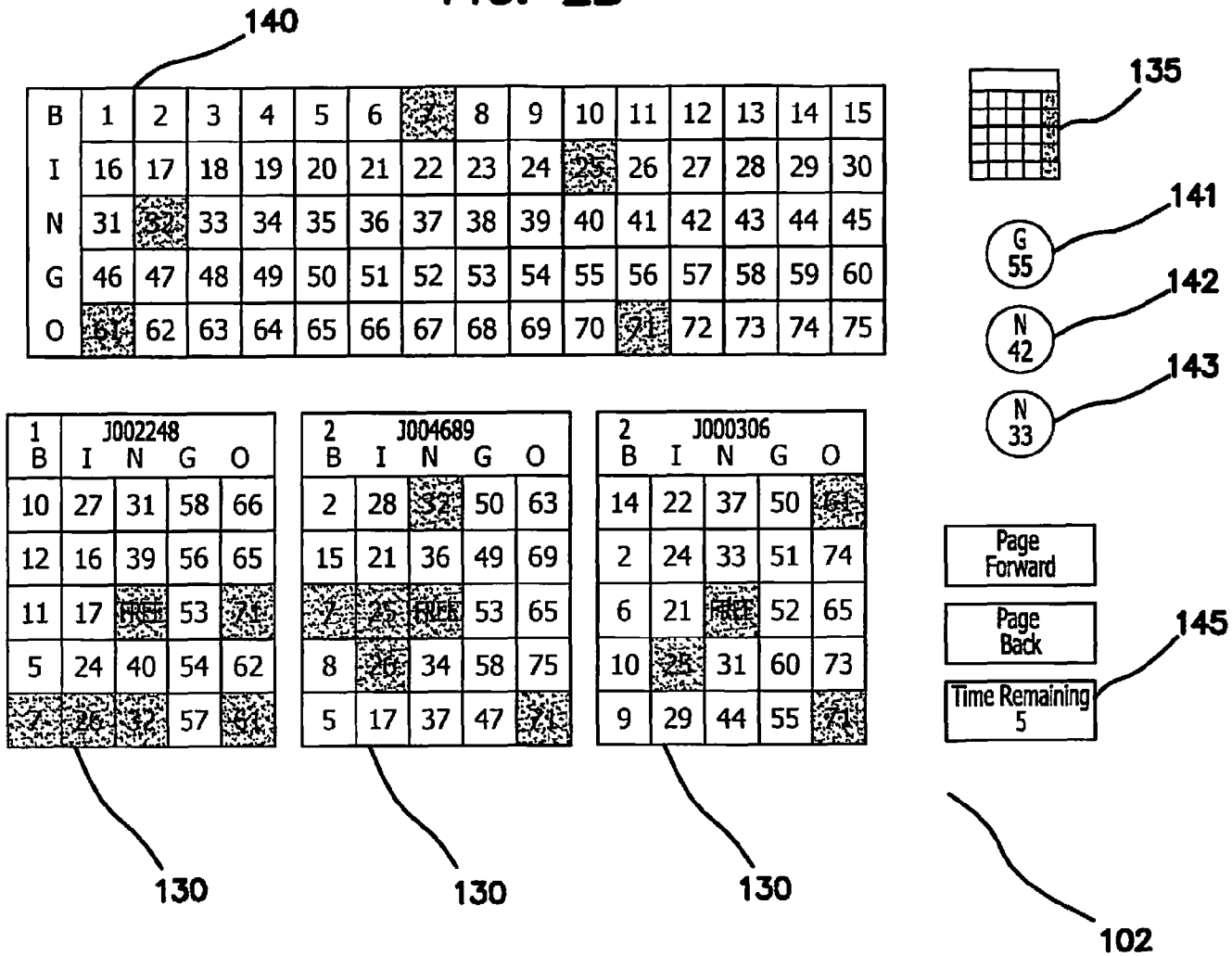
Figure 2C:
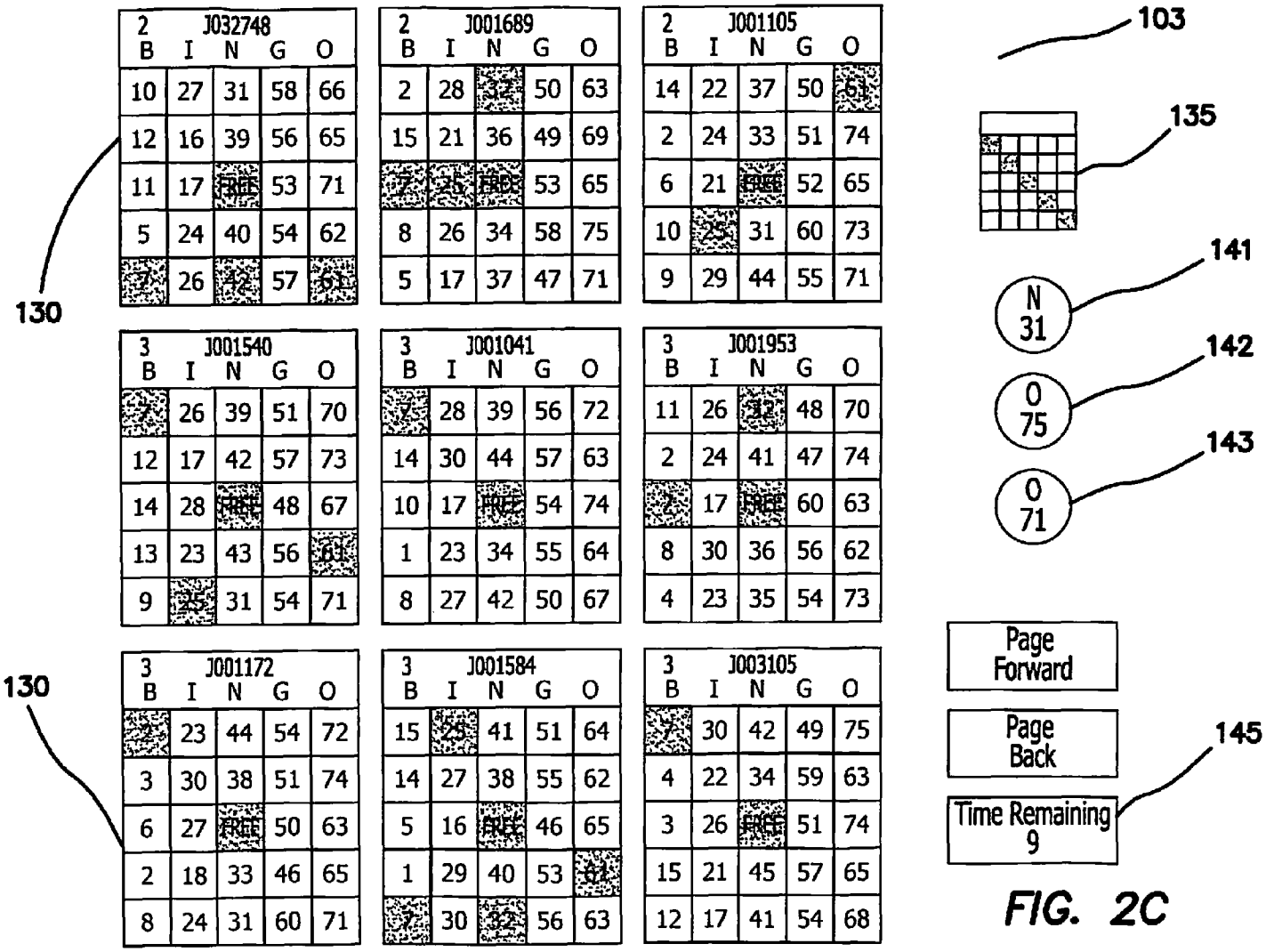
Figure 2D:
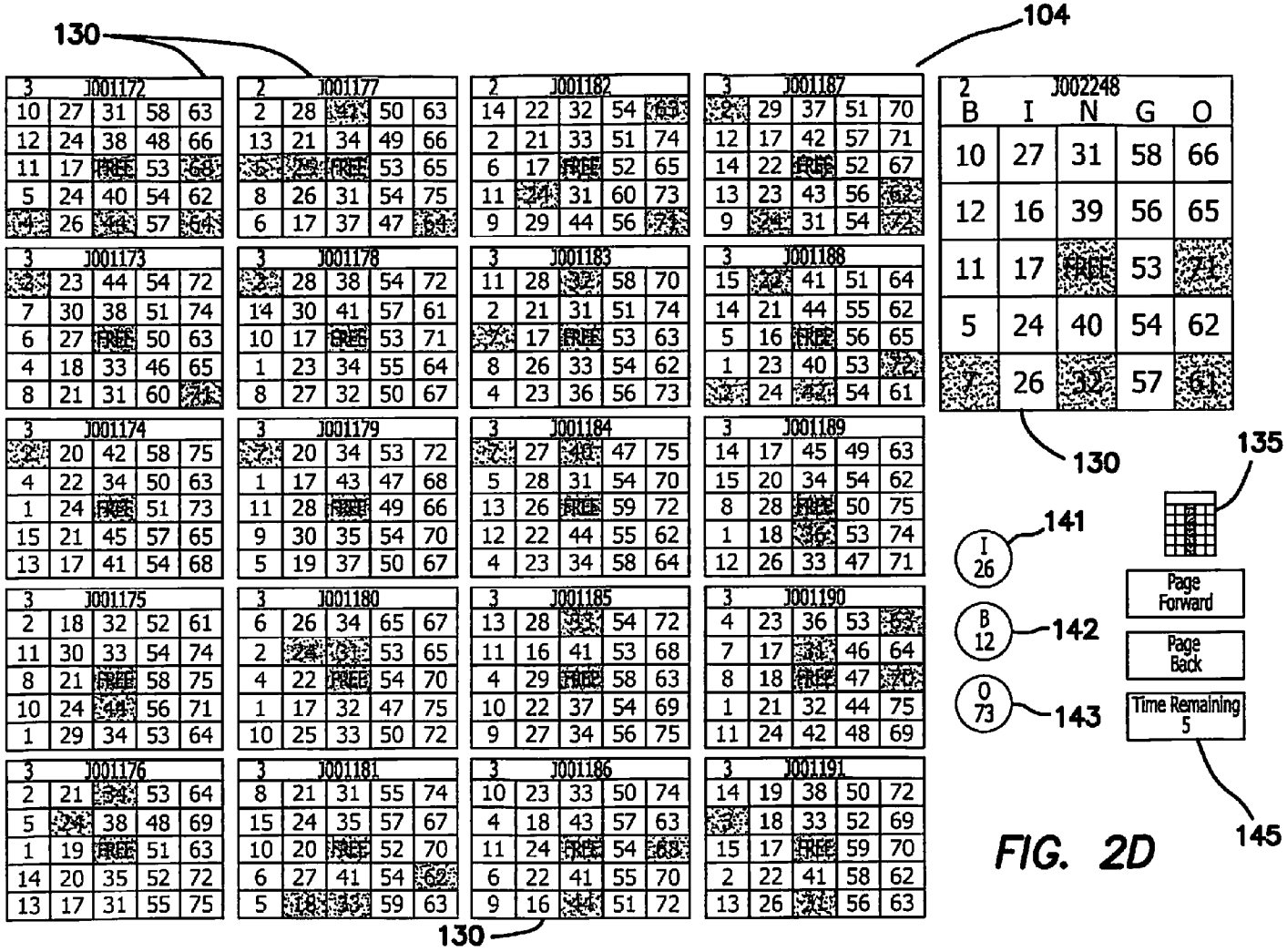

Initial reference is made to FIG. 1 illustrating a screen shot 100 showing a bingo card package purchase arrangement. The package purchase arrangement comprises bingo card purchase arrows 105, number of each card purchased 110, bingo card descriptions 115, purchase price per bingo card type 120 and page control icons 125. The package purchase arrangement is conventional in the art and may be depicted in any number of ways.

FIGS. 2*a*-2*d* show various screen shots 101-104 according to the embodiments of the present invention. Each screen shot 101-104 shows player cards 130, game types 135, bingo board 140 (only shown in screen shot 2*b*), three potential bingo ball numbers 141, 142 and 143, and clock or timer 145. In one embodiment, three randomly selected bingo numbers 141, 142 and 143 are shown to players. Those skilled in the art will recognize that two, or more than three bingo ball numbers may be presented to players. Players are provided with a pre-established time period (e.g., 10 seconds) to vote on one of the three bingo numbers 141, 142 or 143. The vote may be placed via a vote button, touch screen icon or other suitable means. If the player does not vote within the pre-established time period the player is deemed to have not placed a vote. Alternatively, the player may be prompted via visual and/or audio means to place a vote after expiration of the timer. After expiration of the pre-established time period, a system processor, controller or software module tallies the votes and determines the winning bingo ball number according to the vote. The winning bingo ball is then shown to players and the winning bingo ball is applied manually or automatically to each bingo card depicting the bingo number. The game proceeds in this manner until one or more game winners are determined.

As discussed above, given the number of players and bingo cards, the voting option does not impact the randomness of game outcomes. That is, with a large number of players/voters each player/voter will be involved positively and negatively an equal number of times. However, the embodiments of the present invention allow players to interact such that players will believe their vote impacts the game outcomes and provides an advantage despite the fact that over time there is no advantage.

Figure 3:
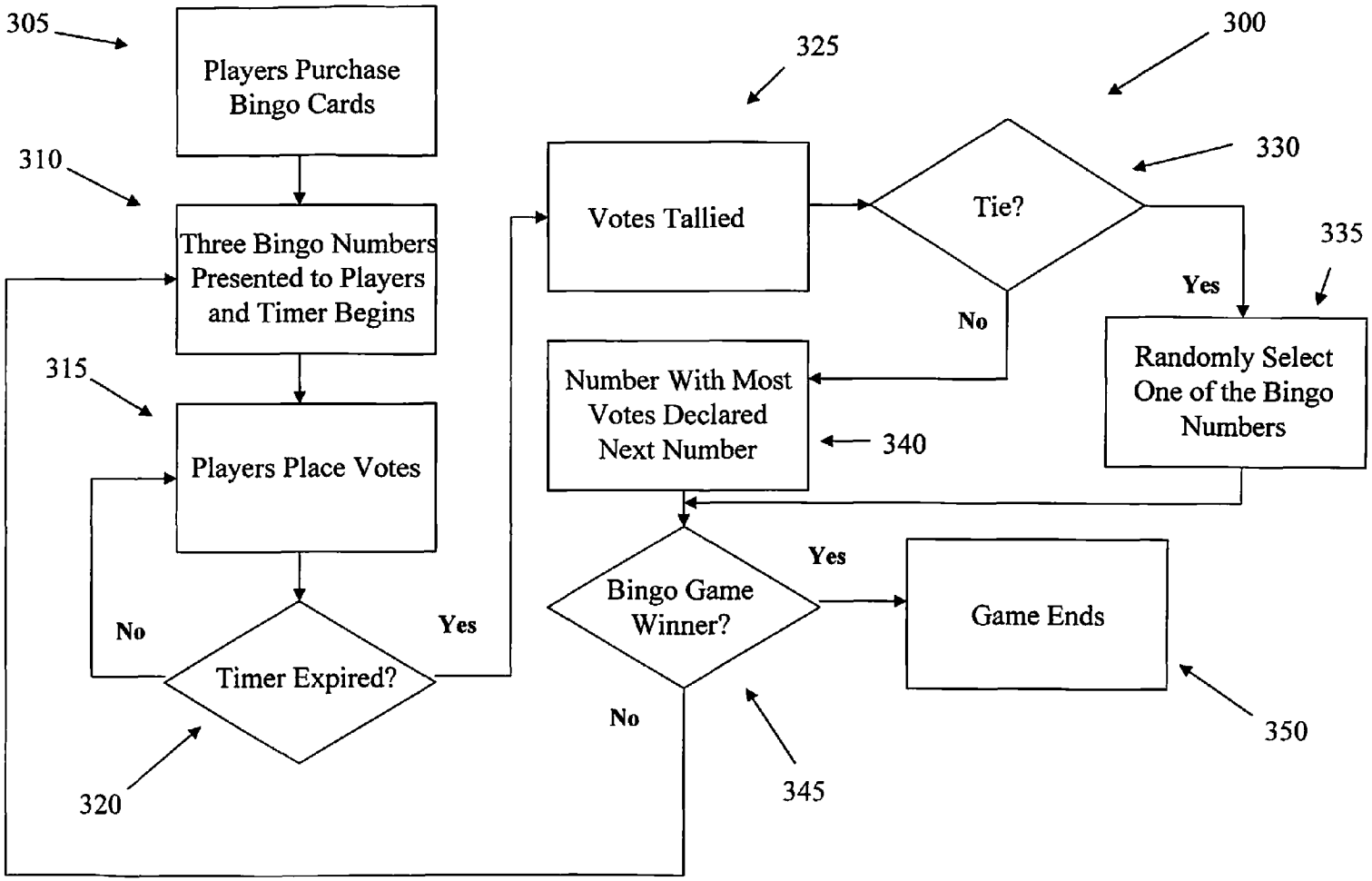
FIG. 3 shows a flow chart detailing one method of play according to the embodiments of the present invention.

FIG. 3 shows a flow chart 300 detailing one bingo embodiment of the present invention. At 305, players purchase bingo cards in a conventional fashion. At 310, players are presented with three bingo numbers and a timer begins. At 315, players place votes on one of the bingo numbers. At 320, it is determined if the timer has expired. If not, the chart 300 loops back to 315. If so, at 325, the votes are tallied. At 330, it is determined if multiple bingo numbers have received the most and same number of votes (i.e., a tie has occurred). If so, at 335, one of the bingo numbers involved in the tie is randomly selected and presented to the players as the next bingo number. If no tie occurs at 330, at 340, the bingo number receiving the most votes is deemed the next bingo number and is presented to the players as the next bingo number and automatically or manually applied (i.e., daubed) on each player's bingo card if warranted. At 345, it is determined if there is a winner. If not, the chart loops back to 310 where three more bingo numbers (from remaining unselected bingo number pool) are presented to the players. If so, the game ends at 350.

Figure 4:
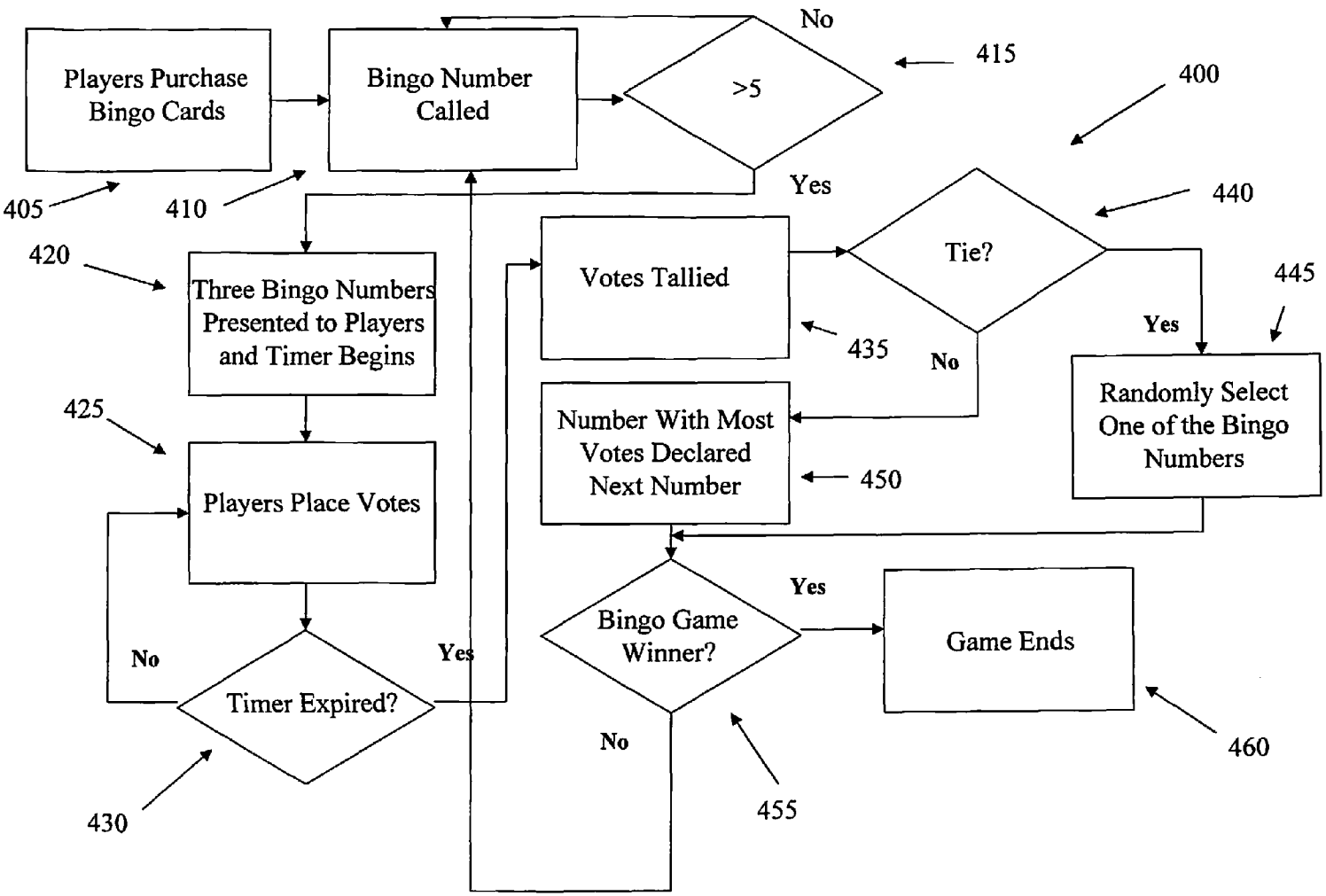
FIG. 4 shows a flow chart detailing another method of play according to the embodiments of the present invention.

In another embodiment, the voting is only offered to the players intermittingly (e.g., every $5^{th}$ bingo ball selection) as detailed in FIG. 4. In this manner, the bingo game may be played faster as some game numbers are selected in the conventional non-voting fashion. FIG. 4 shows a flow chart 400 detailing another bingo embodiment of the present invention. At 405, players purchase bingo cards in a conventional fashion. At 410, a bingo number is randomly drawn. At 415, it is determined if a pre-established number of bingo numbers (e.g., 5) have been randomly drawn. If not, the chart 400 loops back to 410. If so, at 420, players are presented with three randomly selected bingo numbers (from remaining unselected bingo number pool) and a timer begins. At 425, players place votes on one of the three bingo numbers. At 430, it is determined if the timer has expired. If not, the chart 400 loops back to 425. If so, at 435, the votes are tallied. At 440, it is determined if multiple bingo numbers have received the most and same number of votes (i.e., a tie has occurred). If so, at 445, one of the bingo numbers involved in the tie is randomly selected and presented to the players as the next bingo ball. If no tie occurs at 440, at 450, the bingo number receiving the most votes is deemed the next bingo number and is presented to the players as the next bingo number and automatically or manually applied (i.e., daubed) on each player's bingo card if warranted. At 455, it is determined if there is a winner. If not, the chart loops back to 410. If so, the game ends at 460.

In another embodiment, the voting option is only offered responsive to a pre-established minimum number of players and/or bingo cards being involved in the bingo game. Such an embodiment can be used to ensure that the voting does not impact the randomness of the underlying game.

Although the invention has been described in detail with reference to several embodiments, additional variations and modifications exist within the scope and spirit of the invention.

I claim:

1. A method of playing a number game using multiple electronic gaming machines each including at least a display and an interface capable of accepting instructions from a player wherein said multiple electronic gaming machines are in communication with a random number generator and a processor for controlling the number game, comprising:

providing players with a set of player game numbers from a pool of game numbers; and one or more times during the number game via said processor:

(a) randomly selecting via said random number generator two or more game numbers from said pool of game numbers;

(b) presenting to the players via an electronic gaming machine display said randomly selected two or more game numbers;

(c) accepting player votes via said interface on at least one of said two or more randomly selected game numbers;

(d) tallying votes on each of said two or more randomly selected game numbers to determine a game number receiving the most votes; and (e) selecting the game number receiving the most votes.

2. The method of claim 1 further comprising, in the event of tie, randomly selecting as the next game number one of the two or more game numbers receiving the most and same number of votes.

3. The method of claim 1 further comprising limiting steps (a) through (e) to a number game involving a pre-established minimum number of players.

4. The method of claim 1 further comprising utilizing steps (a) through (e) intermittingly throughout the number game.

5. The method of claim 1 further comprising utilizing steps (a) through (e) randomly throughout the number game.

6. A method of playing a bingo game using multiple electronic gaming machines each including at least a display and an interface capable of accepting instructions from a player wherein said multiple electronic gaming machines are in communication with a random number generator and a processor for controlling the bingo game, comprising:

accepting player inputs allowing players via said interface to select bingo cards from a pool of bingo cards; and one or more times during the bingo game via said processor:

(a) randomly selecting via said random number generator two or more bingo numbers from a pool of bingo numbers;

(b) to the players via an electronic gaming machine display said randomly selected two or more game numbers;

(c) accepting player votes via said interface on at least one of said two or more randomly selected bingo numbers;

(d) tallying votes on each of said two or more randomly selected bingo numbers to determine a bingo number receiving the most votes; and (e) selecting the bingo number receiving the most votes.

7. The method of claim 6 further comprising, in the event of tie, randomly selecting as the next bingo number one of the two or more bingo numbers receiving the most and same number of votes.

8. The method of claim 6 further comprising limiting steps (a) through (e) to a bingo game involving a pre-established minimum number of players.

9. The method of claim 6 further comprising utilizing steps (a) through (e) intermittingly throughout the bingo game.

10. The method of claim 6 further comprising utilizing steps (a) through (e) randomly throughout the bingo game.

11. A bingo system comprising:

multiple electronic gaming machines each including at least a display and an interface capable of accepting instructions from a player wherein said multiple electronic gaming machines are in communication with a random number generator and a processor for controlling a bingo game wherein said processor is configured to:

provide players with bingo cards from a pool of bingo cards and accept payment for one or more of said bingo cards; and one or more times during the bingo game:

(a) randomly via said random number generator select two or more bingo numbers from a pool of bingo numbers;

(b) present to the players said randomly selected two or more bingo numbers;

(c) accept player votes via said interface on at least one of said two or more randomly selected bingo numbers;

(d) tally votes on each of said two or more randomly selected bingo numbers to determine a bingo number receiving the most votes; and (e) select the bingo number receiving the most votes.

12. The bingo system of claim 11 wherein said processor is further configured to, in the event of tie, randomly select as the next bingo number one of the two or more bingo numbers receiving the most and same number of votes.

13. The bingo system of claim 11 wherein said processor is further configured to limit steps (a) through (e) to a bingo game involving a pre-established minimum number of players.

14. The bingo system of claim 11 wherein said processor is further configured to utilize steps (a) through (e) intermittingly throughout the bingo game.

15. The bingo system of claim 11 wherein said processor is further configured to utilize steps (a) through (e) randomly throughout the bingo game.

* * * * *